US005628501A

United States Patent [19]

Meier

[11] Patent Number: 5,628,501

[45] Date of Patent: May 13, 1997

[54] APPARATUS FOR PRODUCING PRINTED PRODUCTS

[75] Inventor: Jacques Meier, Bäretswil, Switzerland

[73] Assignee: Ferag AG, Hinwil, Switzerland

[21] Appl. No.: 477,286

[22] Filed: Jun. 7, 1995

[30] Foreign Application Priority Data

Jun. 7, 1994 [CH] Switzerland ..... 01 783/94

[51] Int. Cl.[6] ..... B31F 1/00; B31F 7/00

[52] U.S. Cl. ..... 270/45; 493/444; 493/445

[58] Field of Search ..... 270/45, 51, 52.3, 270/58.21; 493/437, 444, 445, 422, 405

[56] References Cited

U.S. PATENT DOCUMENTS

| | | | |
|---|---|---|---|
| 3,966,185 | 6/1976 | McCain et al. . | |
| 4,022,456 | 5/1977 | Hooper et al. | 493/444 X |
| 4,029,310 | 6/1977 | Reist | 493/426 |
| 5,437,442 | 8/1995 | Petersen | 270/45 |

FOREIGN PATENT DOCUMENTS

| | | |
|---|---|---|
| 0550828 | 7/1993 | European Pat. Off. . |
| 0583602 | 2/1994 | European Pat. Off. . |
| 2609059 | 10/1976 | Germany . |

*Primary Examiner*—John E. Ryznic
*Attorney, Agent, or Firm*—Bell, Seltzer, Park & Gibson, P.A.

[57] ABSTRACT

An apparatus for producing printed products comprising one or more individual sub-products, e.g. newspapers, periodicals and the like. The apparatus comprises a rotating drum or drawing member having a plurality of successive receiving positions. The drum or drawing member is arranged between at least one sub-product feeding station and at least one sub-product removal station. The individual receiving positions each comprise at least one folding device and each folding device comprises a pair of folding rollers and a folding tongue which moves between the folding rollers to fold the sub-product.

15 Claims, 5 Drawing Sheets

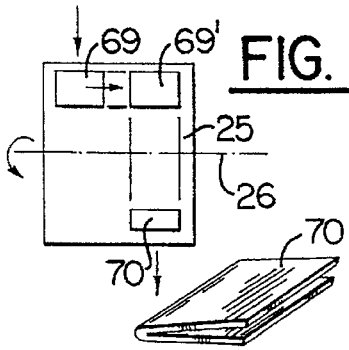
FIG. 6.
FIG. 6A.
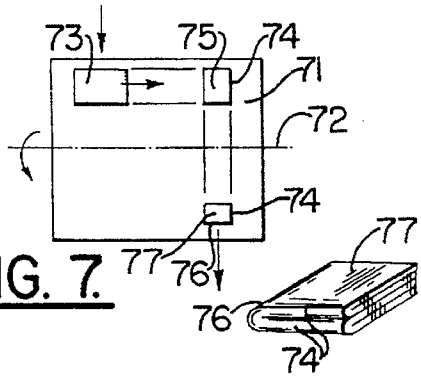
FIG. 7.
FIG. 7A.
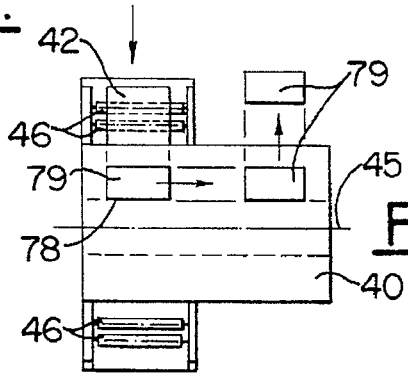
FIG. 8.
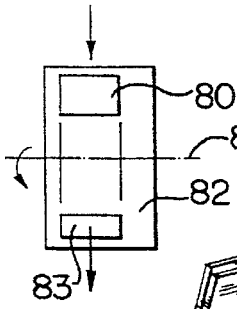
FIG. 9.
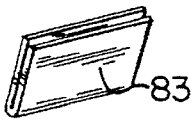
FIG. 9A.
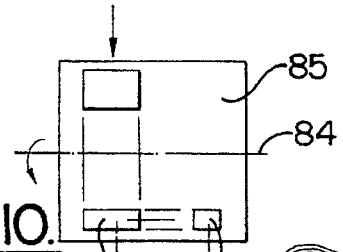
FIG. 10.
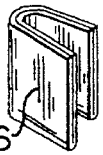
FIG. 10A.
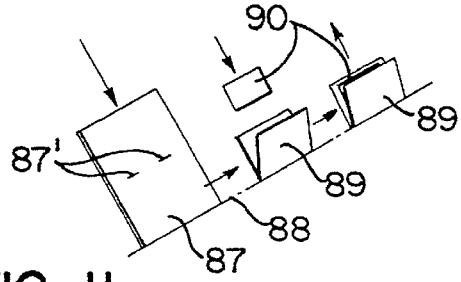
FIG. 11.
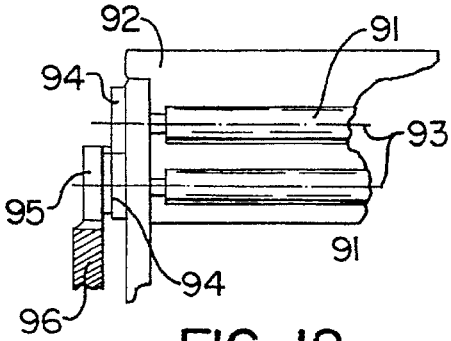
FIG. 12.

APPARATUS FOR PRODUCING PRINTED PRODUCTS

BACKGROUND OF THE INVENTION

The invention relates to an apparatus for producing printed products comprising one or more individual sub-products, e.g. newspapers, periodicals and the like, having a plurality of successive receiving positions arranged between at least one sub-product feeding station and at least one product removal station.

The prior art discloses apparatuses which may be provided upstream or downstream of apparatuses for collating or processing printed products and which are suitable only for folding printed products.

Thus, for example, European Patent Application EP-A-0583602 discloses a folding apparatus to which individual sheets, or groups of sheets, which are to be folded can be fed in series, it then being possible for such sheets or groups of sheets to be folded simultaneously in a plurality of folding units. In this arrangement, the folding units exhibit transversely movable folding rollers between which the sub-products which are to be folded can be moved by means of a folding blade.

U.S. Pat. No. 3,966,185 also discloses a folding device with two interacting folding rollers between which the sub-product which is to be folded can be moved by means of a folding blade.

Finally, German DE-OS 26 09 059 gives a description of a device for folding printed sub-products, in which printed sub-products which are to be folded can each be folded within a compartment of a star feeder which is circularly driven.

These known apparatuses can be combined only with a high degree of precision to effectively collate or process printed products, and some of the known apparatuses are mechanically complicated and some are not suitable for processing a continuous sub-product stream.

SUMMARY OF THE INVENTION

An object of the present invention is to provide an apparatus which can be produced economically and can be combined with other apparatuses in a simple manner to collate or process printed products, as well as being suitable for processing a continuous sub-product stream.

This object is achieved according to the present invention in that individual receiving positions are each provided with at least one folding device, each folding device comprising a pair of folding rollers and a folding tongue which moves between the folding rollers and the sub-product to be folded.

Since, according to the invention, all the receiving positions are each provided with at least one folding device, it is possible to select the point in time of the initiation of the folding operations individually in accordance with the given requirements. In the case of a continuously occurring stream of products or sub-products which are to be folded, the folding operations are preferably initiated in the individual receiving positions when the respective receiving position passes a specific location of the processing section. In this case, the folding operations are each initiated one after the other in successive receiving positions.

It is, however, also conceivable to initiate the folding operations simultaneously in all the receiving positions or in at least some of the receiving positions.

Furthermore, according to the invention, the receiving positions may also each be provided with two or more folding devices, as a result of which the sub-products located in the receiving positions can be correspondingly folded a number of times. In particular, it is possible to design the folding devices such that folds running perpendicularly with respect to one another can be produced one after the other.

Furthermore, the individual folding devices may preferably be designed such that, in accordance with the necessary further processing of the folded printed products, the respectively produced fold of an essentially rectangular printed product may come to lie on the left, on the right, at the top or at the bottom.

Finally, it is possible to use folding devices which, by way of the folding operation, ensure continuous further transportation of the printed products in the receiving positions, perpendicularly with respect to the movement direction thereof. In this manner, it can be ensured that the printed products continuously pass through, for example, an essentially helical processing section since, even during the folding operation, transportation in the direction of the longitudinal axis of the essentially helical processing section is ensured.

In a preferred embodiment of the invention, the folding devices may be provided in the receiving positions of a processing section which are arranged between at least one sub-product feeding station and at least one product removal station along the processing section, provision being made for collecting, insertion, collating, stapling and/or adhesive bonding stations which interact with the receiving positions.

The receiving positions of such an apparatus are charged, along the processing section, with a number of individual sub-products, as a result of which one printed product comprising a plurality of individual sub-products is brought together in the individual receiving positions. This is effected by processing stations arranged along the processing section, by means of which processing stations the individual sub-products are collated, collected and/or inserted. In addition, further processing stations designed, for example, as adhesive-bonding, stapling and/or card-bonding stations may be provided along the processing section.

By means of the present invention, an apparatus of this type can be designed such that individual sub-products or products comprising a plurality of individual sub-products can be folded during passage through the processing section.

By virtue of the integration of the folding devices into the processing section, the possible applications of an apparatus of the type mentioned in the introduction are considerably increased since, without using a separate folding device provided outside the processing section, folding of the printed sub-products is also possible in addition to bringing-together, stapling and/or adhesive bonding, it being possible with the folding devices integrated into the processing section to fold both unfolded and already pre-folded printed sub-products comprising one or more individual sub-products. If required, the printed sub-products may already be pre-stapled.

In this manner, folded printed products can be produced rapidly and simply with low costs since separate folding devices which are not connected to the processing section do not have to be provided and transfer of the printed products from a separate folding device to the processing section or vice versa does not have to be ensured.

However, if required, it is also possible to use the present apparatus only for folding printed sub-products. This provides greater utility and increases the number of applications for the apparatuses according to the present invention.

BRIEF DESCRIPTION OF THE DRAWINGS

The invention is described hereinbelow by way of example with reference to the possible embodiments represented in the drawings, in which:

FIG. 6 shows the flow chart of a folding operation which can be effected by the embodiment according to FIG. 3;

FIG. 6A is an enlarged perspective view of the folded product produced by the method of FIG. 6;

FIG. 7 shows the flow chart of a folding operation which can be carried out by a combination of the embodiment according to FIGS. 1 and 3;

FIG. 7A is an enlarged perspective view of the folded product produced by the method of FIG. 7;

FIG. 8 shows the flow chart of a folding operation which can be effected by the embodiment according to FIG. 4;

FIG. 9 shows the flow chart of a folding operation which can be effected by the embodiment according to FIG. 3 or 4;

FIG. 9A is an enlarged perspective view of the folded product produced by the method of FIG. 9;

FIG. 10 shows the flow chart according to FIG. 9 including the performance of a further folding operation;

FIG. 10A is an enlarged perspective view of the folded product produced by the method of FIG. 10;

FIG. 11 shows the flow chart of a folding operation carried out according to the invention, with a combined insertion operation; and FIG. 12 shows a drive flow chart for folding rollers of a folding device according to the invention.

DETAILED DESCRIPTION OF THE INVENTION

Figure 1:
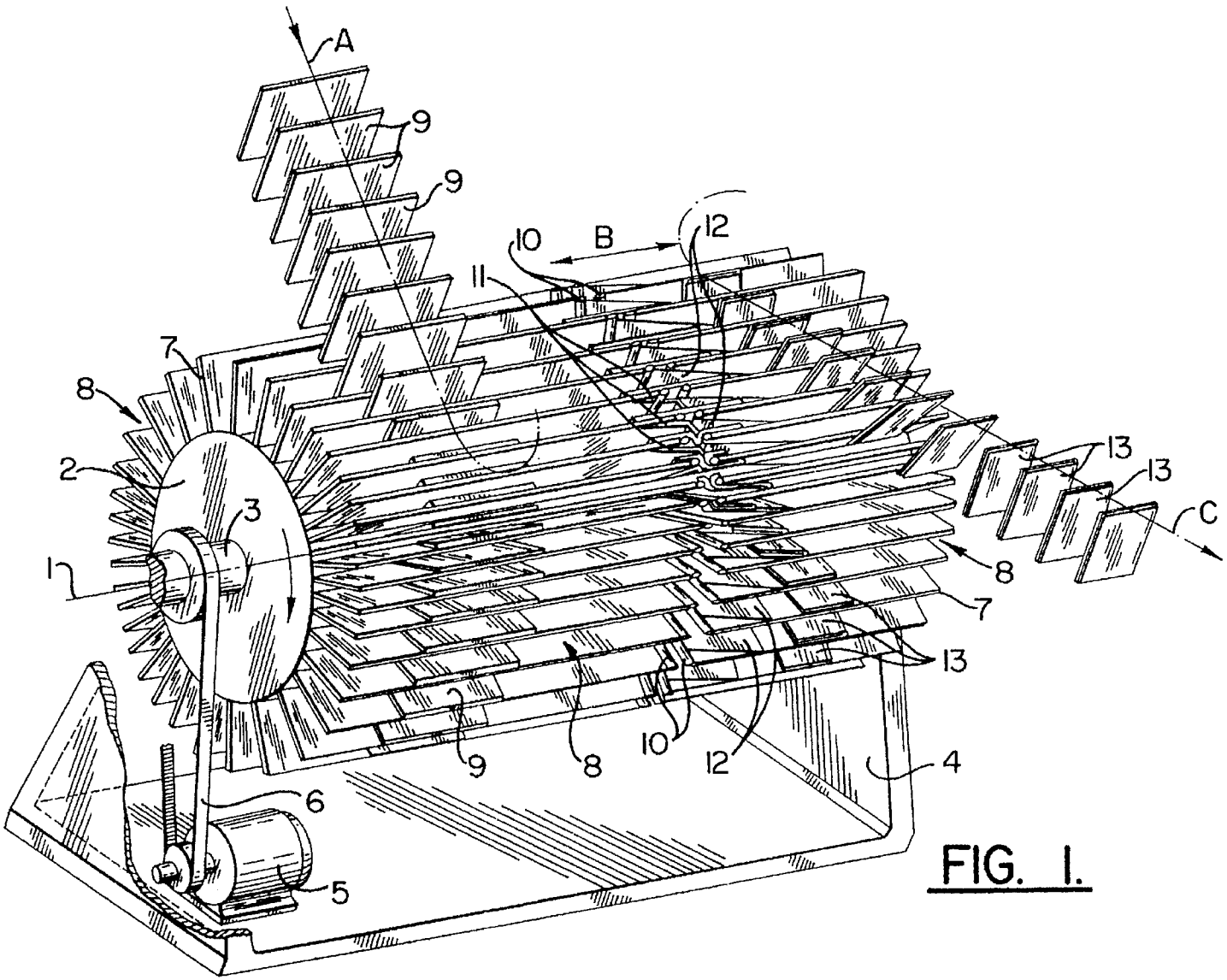
FIG. 1 shows a first embodiment of a processing drum according to the invention.

FIG. 1 shows a cylindrical processing drum 2 which is rotatably driven about an essentially horizontal axis 1 and is mounted in a framework 4 via a shaft 3. Connected to the framework 4 is a drive motor 5 which is coupled to the shaft 3 via a drive belt 6.

The processing drum 2, which is driven in rotation in the arrow direction, is provided with wall elements 7 which extend radially from the axis 1 of the processing drum 2 and are arranged on the processing drum 2 such that they are distributed at regular intervals in the circumferential direction of the same. Formed between each adjacent wall element 7 is one pocket-like compartment 8 which serves to receive printed sub-products 9. The processing drum 2 is coupled to a sub-product feeding station (not shown) by means of which individual printed sub-products, each retained by a gripper, are fed to the processing drum 2 along a section designated by A. In the folding portion designated by B with respect to the longitudinal axis 1 of the processing drum 2, the wall elements 7 are each provided with a folding device.

In this arrangement, each of these folding devices comprises a pair of folding rollers 10 which, with their longitudinal axis, extend away radially from the axis of rotation 1 of the processing drum 2 in the plane of the respective wall elements 7. In this arrangement, the wall elements 7 are interrupted by the folding rollers 10 in the region provided for the same. By way of the gap formed between two interacting folding rollers 10, two mutually adjacent pocket-like compartments 8 are in connection with one another.

Furthermore, some compartments 8 are provided with a folding tongue 11, represented schematically in FIG. 1 which serves to move between two interacting folding rollers 10, and also forcing the region of a sub-product 9 which is to be folded between the folding rollers 10. The folding tongues 11 have acting upon them one actuating mechanism (not shown in FIG. 1) so that the leading edge of the folding tongue can be moved in the direction of the gap formed between two interacting folding rollers 10.

The folding rollers 10 have acting upon them one rotary drive (likewise not shown in FIG. 1) which ensures that two interacting folding rollers are driven in opposite directions of rotation about their respective longitudinal axes.

On the side which is directed away from the respectively assigned folding tongue 11, each pair of folding rollers 10 exhibits a guide element 12 for the folded products 13. In this arrangement, the guide element 12 extends from the outlet side of the gap formed between two folding rollers 10, offset in the direction of the axis 1 of the processing drum 2, of the wall element 7 adjacent to the folding rollers be on the outlet side thereof.

The folding portion B of the processing drum 2 is adjoined by a product removal station (not shown in FIG. 1) by means of which the folded products 13 can be conveyed away from the processing drum 2, the products each being retained by a gripper (likewise not shown in FIG. 1). In this arrangement, the conveying-away of the folded products 13 takes place along a removal section identified by C.

The apparatus represented in FIG. 1 operates as follows:

As the processing drum 2 is rotated via drive belts 6 and drive motor 5, printed sub-products 9 which are to be folded are fed to the individual compartments 8. In this arrangement, the sub-products can be fed via a clamp transporter, a conveying belt or another kind of conveying device which removes the sub-products 9, for example, from a stack.

By charging the processing drum 2 with printed sub-products 9 which are to be folded, a printed sub-product 9 is introduced into each of the compartments 8 following one after the other in the circumferential direction of the processing drum 2. The sub-product feeding section A is arranged such that the printed sub-products 9 which are to be folded are deposited in the compartments 8 upstream of the folding portion B, as seen in the processing direction.

The printed sub-products 9 deposited in the compartments 8 in this manner thereafter describe a circulatory path about the processing drum 2, the sub-products simultaneously being transported in the direction of the axis of rotation 1 of the processing drum 2, by means of conveying means (not shown in FIG. 1), into the region of the folding portion B, with the result that the printed sub-products 9 which are to be folded ultimately describe an essentially helical circulatory path along the processing section.

In this arrangement, the printed sub-products 9 which are to be folded are transported into the folding portion B to such an extent that the region of the printed sub-products which is provided for the fold edge lies in the region of the gap formed between two folding rollers 10.

Subsequently, the folding tongue 11 assigned to the respective gap is actuated so that the region of the printed sub-product 9, which is to be folded is moved into the gap formed between the respective folding rollers 10.

In this arrangement, the folding rollers 10, which are made to rotate, clamp the printed sub-product 9 to be folded therebetween and convey the simultaneously folding sub-product onto the side of the wall element 7 provided with respective folding rollers 10 which is directed away from the respectively assigned folding tongue 11.

On the side of the folding rollers 10 which is directed away from the folding tongue 11, the folded printed product 13 is deflected and guided by way of the guide element 12 such that it is carried out in the direction of the axis of rotation 1 of the processing drum 2. The result is that the folded printed product 13 moves further essentially on a continuous, essentially helical path about the axis of rotation 1 of the processing drum 2.

By means of the folding devices represented in FIG. 1, the folding operation is effected such that the fold edge comes to lie, within the compartments 8, at the front, as seen in the transporting direction.

The folded product 13 is then seized in turn by a conveying mechanism (not shown in FIG. 1) which, furthermore, ensures a conveying operation in the direction of the axis of rotation 1 of the processing drum 2, with the result that, after the folding portion B, the movement of the product 13 describes an essentially helical path about the axis of rotation 1 of the processing drum 2.

Since the folding device, comprising essentially folding rollers 10, folding tongue 11 and guide element 12, is arranged within each wall element 7 which delimits two adjacent compartments 8 from one another, the sub-product or product 9, 13, respectively, is moved, during the folding operation, through that portion of the respective wall element 7 which is interrupted by the folding rollers 10, as a result of which the folded product 13 finally comes to lie in a compartment 8 which is adjacent, in the circumferential direction of the processing drum 2, to that compartment 8 into which the sub-product 9 has been introduced along the sub-product feeding section A before the performance of the folding operation.

By virtue of the essentially helical further conveying of the folded printed product 13, the latter finally passes into the region of the product removal station (not shown in FIG. 1), which ensures that the folded printed products 13 are conveyed away from the processing drum 2 along the product removal section C. In this arrangement, the product removal station may be designed, in the same way as the sub-product feeding station, as a clamp transporter, as a conveying belt or the like.

The transporting means (not shown in FIG. 1) which convey the sub-products in the direction of the axis 1 of the processing drum 2 may, at the same time, also serve to prevent the sub-products from falling out of the compartments 8 in the lower portion of the processing drum 2.

By means of a first embodiment of the apparatus represented in FIG. 1, both unfolded and already pre-folded sub-products may be processed, it being possible for the sub-products to comprise one or more individual sub-products.

Figure 2:
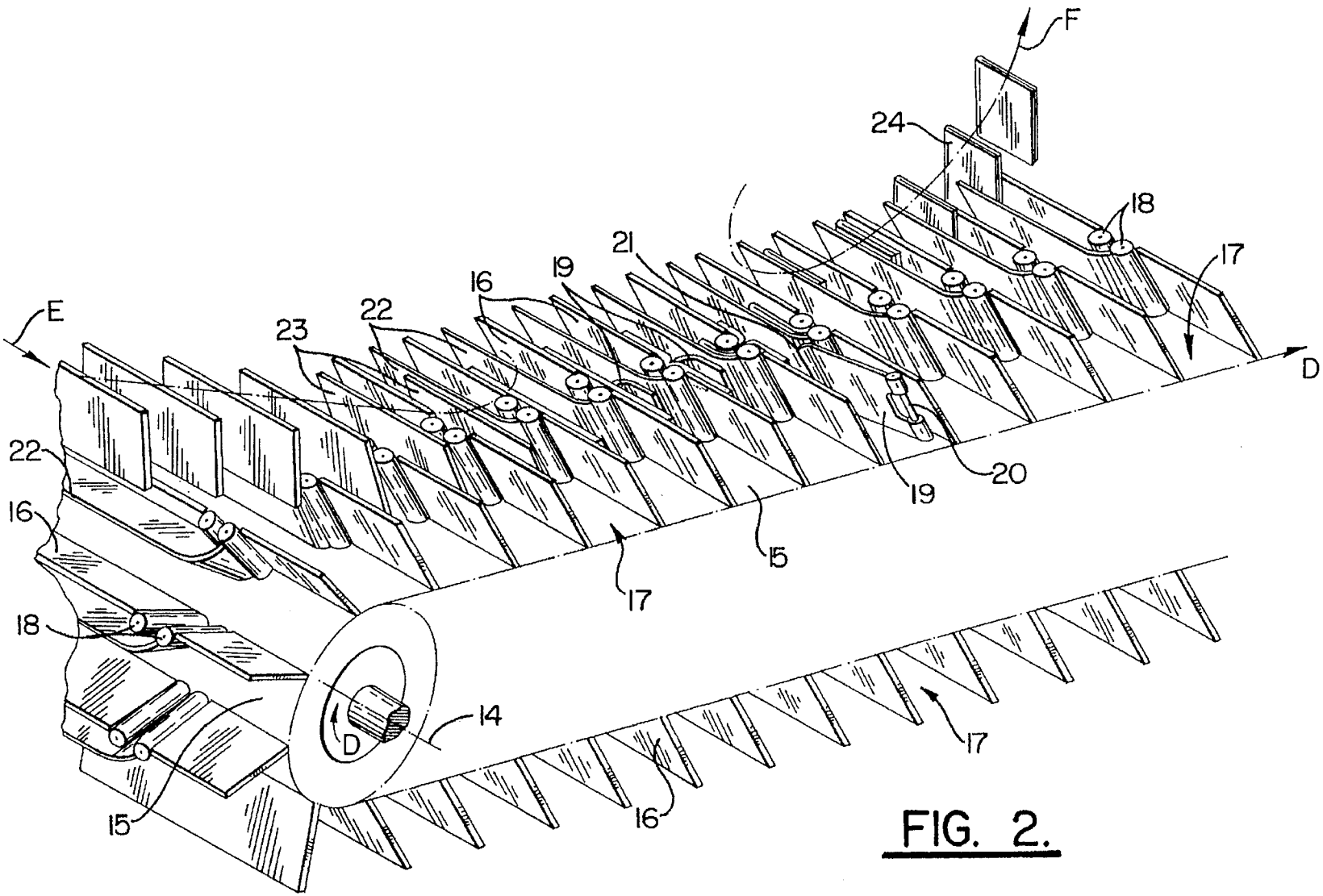
FIG. 2 shows a circulating system according to the invention.

FIG. 2 shows a second embodiment of the present invention comprising a drawing member 15 which is driven in circulation in the direction of the arrows D about two spaced-apart horizontal axes 14, of which only one is represented in FIG. 2, and is designed, for example, in the form an endless belt.

Wall elements 16 which extend essentially perpendicularly with respect to the drawing member 15 are arranged on the drawing member 15 such that they are distributed at regular intervals in the direction of circulation of the same. In this arrangement, the wall elements 16 are slightly inclined counter to the direction of circulation D of the drawing member.

Pocket-like compartments 17 which are of an essentially U-shaped cross-section are formed between the wall elements 16.

The wall elements 16 are each interrupted by an arrangement of two folding rollers 18 which run perpendicularly with respect to the horizontal axis 14 and of which the axes of rotation each run parallel to the wall elements, a tangent which is common to a pair of folding rollers 18 running essentially in the plane of the wall elements 16 interrupted by the respective folding rollers 18.

On the drawing-in side of the folding rollers 18, in each case one folding tongue 19 is arranged such that it can be pivoted about a pivot axis 20, which folding tongue, for reasons of clarity, is depicted in FIG. 2 to the full extent only in one compartment and is indicated schematically in two further compartments.

The folding tongue 19, interacting in each case with a pair of folding rollers 18, is fitted in each case on the wall element 16 arranged upstream of the pair of folding rollers 18, as seen in the transporting direction, the pivot axis 20 of the folding tongue 19 extending parallel to the axes of rotation of the folding rollers 18. In this arrangement, the folding tongues 19 can be pivoted about their pivot axis 20 in such a manner that the respective folding edge 21 of the folding tongues 19 can be moved, on the respective drawing-in side of the respective pair of folding rollers 18, in the direction of the gap formed between the folding rollers 18.

Provided on the outlet side of each pair of folding rollers 18 is a partition wall 22 which is curved in the direction of the respective outlet gap and subdivides each compartment 7 into a conveying-in sector for a first pair of folding rollers 18 and a conveying-away sector for a second pair of folding rollers 18, which is adjacent to the first in the conveying direction of the drawing member 15.

In this arrangement, the partition walls 22 extend in the form of an arc from the outlet gap of the folding rollers 18 as far as the region located approximately in the center between two adjacent wall elements 16, where they then run parallel to the wall elements 16.

Provided on one side of the upper strand of the drawing member 15 is a sub-product feeding station (not shown in FIG. 2) which moves the sub-products 23 which are to be folded, along the sub-product feeding section indicated by E, into the respective conveying in sector of a pocket-like compartment 17. In this arrangement, the sub-product feeding section E runs essentially in a plane parallel to the upper strand of the drawing member 15.

Provided on the other side of the upper strand 15 is a product removal station (likewise not shown in FIG. 2) by means of which the folded products 24 are removed from the respective conveying-away sectors of the pocket-like compartments 17. In this arrangement, conveying-away takes place along a product removal section F.

The apparatus represented in FIG. 2 functions as follows:

The drawing member 15 is driven in circulation about the axis 14 and about a further axis (not shown in FIG. 2) which is parallel to the axis 14, sub-products 23 which are to be folded being fed simultaneously along the sub-product feeding section E. In this arrangement, the speed of the sub-product feeding station is synchronized with the speed of circulation of the drawing member 15, with the result that in each case one sub-product 23 which is to be folded is deposited in all the successive compartments 17.

The sub-product feeding station, designed, for example, as a clamp transporter, is arranged relative to the apparatus represented in FIG. 2 such that the fed sub-products 23 are retained and transported by the conveying-in device until the sub-products 23 come to lie within the compartments 17 such that the region of the sub-products 23 which is to be folded is located directly upstream of the drawing-in gap of the respective folding rollers 18. In this manner, a separate transporting device, which is provided in the respective compartments 17 and conveys the sub-products 23 along the compartments 17 to the position in which the folding operation can be initiated, may be dispensed with.

As soon as the sub-product feeding station has conveyed the sub-product 23 which is to be folded in each case into the folding position, the sub-product which is to be folded is released by the sub-product feeding station. In this position, the sub-product which is to be folded is located between the folding rollers be, whereby the folding operation is carried out, and the folding edge 21 of a folding tongue 19 assigned to said folding rollers 18.

The respective folding tongue 19 is then pivoted about its spindle 20, as a result of which that region of the sub-product 23 which is to be folded is forced into the drawing-in gap of the folding rollers 18 by means of the folding edge 21, whereupon the rotating folding rollers 18 seize the sub-product 23 in the region which is to be folded.

The sub-product 23 which is to be folded is then drawn, with the fold edge leading, through the gap formed between the folding rollers 18, the folded product 24 being guided, on the outlet side of the folding rollers 18, by way of the curved region of the respective partition wall 22 into the respective conveying-away sector which is formed between a wall element 16 and a partition wall 22.

By virtue of the guidance of the folded product 24 and the rotation of the folding rollers 18, the folded product 24 is conveyed away from the folding rollers 18 along the conveying-away sector. A separate transporting device to be provided in the respective conveying-away sector is thus also not provided for the conveying-away of the folded product 24 from the folding rollers 18.

In the conveyed-away position, the folded products 24 are transported away from the product removal station (not shown in FIG. 2) along the product removal section F.

In the case of the apparatus represented in FIG. 2, all the conveying operations are carried out by the sub-product feeding unit, the folding rollers 18 or the product removal station. Separate transporting devices within the individual compartments 17 and within the respective conveying-in sector and conveying-away sector are not required. It is, however, also conceivable to provide the individual compartments 17 with such separate transporting devices for other application cases.

By means of the apparatus represented in FIG. 2, both already pre-folded and unfolded sub-products may be processed. Furthermore, the compartments 17 may be provided with two or more folding devices to provide the individual sub-products with two or more folds which may be oriented differently.

Figure 3:
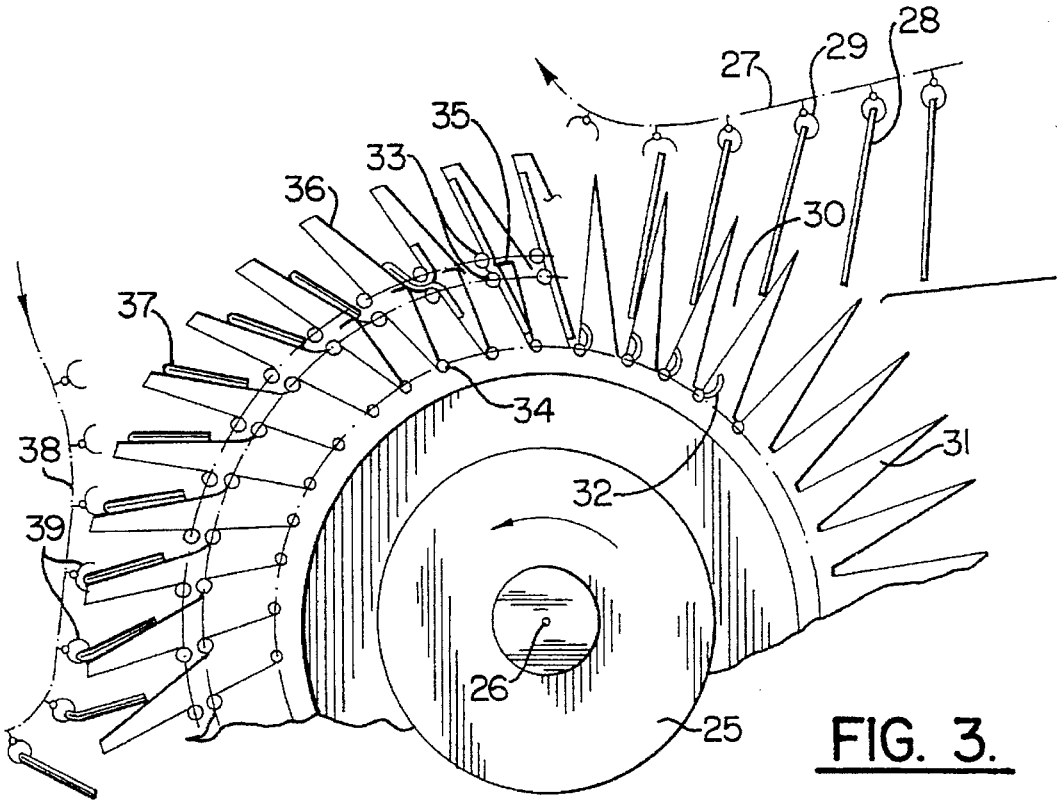
FIG. 3 shows a section through a second embodiment of a processing drum according to the invention.

FIG. 3 shows a processing drum 25 which corresponds to an apparatus according to FIG. 1 and is rotatably driven in the arrow direction.

FIG. 3 shows a section through the processing drum 25 in two different planes offset along the axis of rotation 26 of the drum 25.

The first section plane, represented on the right in FIG. 3, is located in the region of a sub-product feeding station 27 which is designed as a clamp transporter, retains, by means of a clamp 29 in each case, sub-products 28 which are to be folded and moves the latter into compartments 30 which are formed between saddle-like wall elements 31 extending away radially from the drum 25.

In this arrangement, each compartment 30 is provided, in its region directed towards the axis of rotation 26 of the processing drum 25, with a pivotable clamp element 32 by means of which the sub-products 28 located in the compartments 30 can be conveyed along the individual compartments 30 transversely with respect to the direction of rotation of the processing drum 25. The clamp elements 32 are likewise suitable for securing the sub-products 28 against falling out of the compartments 30 in the lower region of the processing drum 25.

If the sub-product feeding station is designed such that the sub-products 28 are deposited in the compartments 30 in such a manner that a transporting process running transversely with respect to the direction of rotation of the processing drum 25 is rendered superfluous, the clamp elements 32 merely fulfil the above-described retaining function.

The section plane represented in the left-hand region of FIG. 3 runs in a manner offset along the longitudinal axis 26 of the processing drum 25 with respect to the region of the sub-product feeding station 27. In this plane, the partition walls 31 are provided with folding devices which, analogously to the representations in FIGS. 1 and 2, comprise essentially a pair of folding rollers 33, a folding tongue 35 which can be pivoted about a spindle 34, and a guide element 36 for the folded product 37.

In contrast to the apparatus represented in FIG. 1, the folding rollers 33 run essentially in the plane of the wall elements 31, parallel to the axis of rotation 26 of the processing drum 25. In this respect, an apparatus represented in FIG. 3 can produce a fold which runs perpendicularly with respect to a fold which can be produced by an apparatus represented in FIG. 1.

Provided in the region of the folding devices is a product removal station 38 which runs essentially tangentially and vertically past the processing drum 25 and is designed, just as the sub-product feeding station 27, as a clamp transporter.

The apparatus represented in FIG. 3 functions as follows:

The sub-products 28 which are to be folded are introduced into the successive compartments 30 via the sub-product feeding station, of which the transporting speed is synchronized with the speed of rotation of the processing drum 25.

In the compartments 30, the clamp elements 32 seize the sub-products 28 which are to be folded, retain them and convey them, if appropriate, transversely with respect to the direction of rotation of the processing drum 25.

Once the sub-products 28 which are to be folded are positioned with respect to the folding devices such that the region which is to be folded comes to lie opposite the drawing-in region of the folding rollers 33, the sub-products which are to be folded are released from the clamp elements 32. A pivoting movement of the folding tongue 35 is then initiated, which movement forces that region of the sub-products 28 which is to be folded into the gap formed between the folding rollers 33. In the case of the apparatus represented in FIG. 3, the fold is always produced at a distance from that end of the sub-product 28 which is directed towards the axis of rotation 26 of the processing drum 25, which distance corresponds to the distance between that end of the compartments 30 which is directed towards the axis of rotation 26 and the gap formed between the folding rollers 33 and running parallel to the axis of rotation 26.

By virtue of the rotation of the folding rollers 33, the sub-product which is to be folded is drawn through the gap formed between the folding rollers 33 and is subsequently deflected by way of the guide element 36 such that the folded product 37 is conveyed away approximately radially from the axis of rotation 26 of the processing drum 25 with its fold edge in front. In this arrangement, the guide element 36 preferably runs not precisely radially with respect to the axis of rotation 26 of the processing drum 25, but is inclined slightly in the direction of rotation of the processing drum 25.

By virtue of the rotation of the processing drum 25 which continues after the folding operation, the folded product 37 on the guide element 36 finally passes into such an oblique position that, due to the force of gravity, it slides away on the guide element 36 essentially radially from the axis of rotation 26 of the processing drum 25, said sliding operation finally being braked by in each case one clamp 39 of the product removal station 38 since the radially sliding away folded product 37 comes to butt against an open clamp 39, which is moved in each case synchronously with respect to the rotary movement of the processing drum 25.

Subsequently, the folded product 37 which butts against the clamp 39 is seized on the folded side by the closing clamp 39 and is conveyed away from the processing drum 25.

Figure 4:
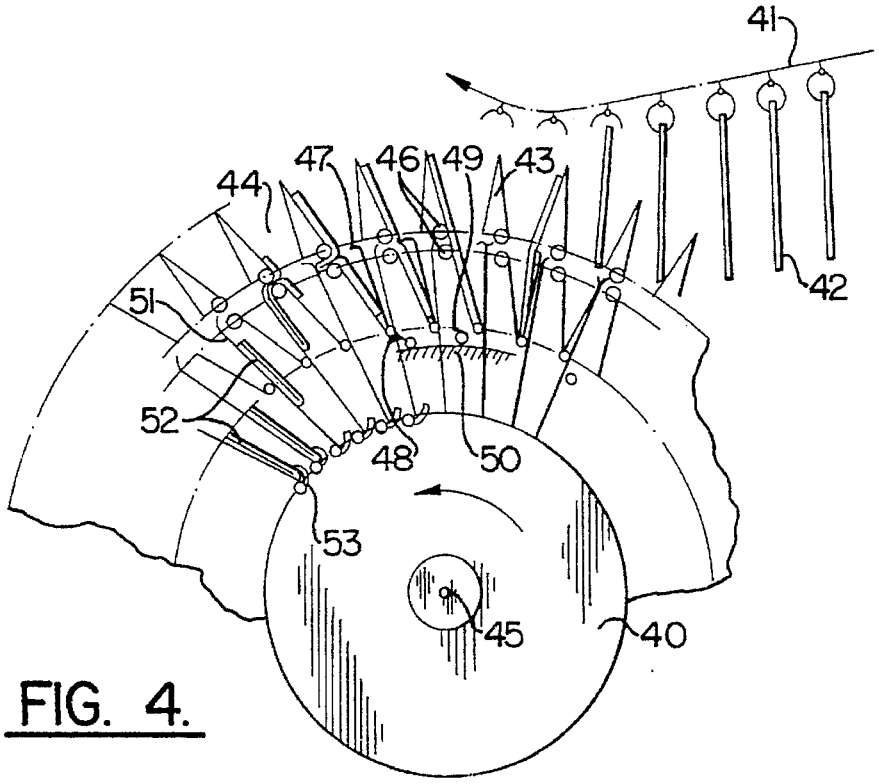
FIG. 4 shows a section through a third embodiment of a processing drum according to the invention.

FIG. 4 shows an alternative embodiment of a folding sector, represented in the left-hand region of FIG. 3, of a processing drum 40 rotating in the arrow direction.

The differences from the apparatus represented in FIG. 3 are explained hereinbelow:

By means of the sub-product feeding station 41, the sub-products 42 which are to be folded are fed to compartments 44, formed between wall elements 43, of the processing drum 40 rotating about the axis 45.

Each compartment 44 is provided with a pair of folding rollers 46 which are arranged, in accordance with FIG. 3, in the wall elements 43.

In each case one folding tongue 47 interacts with a pair of folding rollers 46, said folding tongue 47 being mounted in each case such that it can be pivoted about the pivot axis 48 and being connected to a lever element 49. Upon rotation of the processing drum 40, the lever element 49 runs over a stationary guide 50 which deflects the lever element 49 in such a manner that the folding tongue 47 connected thereto is moved in the direction of the gap formed between two folding rollers 46.

The sub-product 42 drawn between two folding rollers 46, with simultaneous folding, is deflected on the outlet side of the folding rollers 46 by a guide element 51 in such a manner that it is moved radially in the direction of the axis of rotation 45 of the processing drum 40 with its fold edge in front. Once the folded product 52 has been released from the folding rollers 46, it slides further, due to the action of the force of gravity, radially in the direction of the axis of rotation 45 of the processing drum 40 until it finally comes to butt against that end region of the compartment 44 which is directed towards the axis of rotation 45. In said region, the folded product 52 is seized by a pivotable clamp element 53, the folded product 52 being retained by the clamp element 53 on the side provided with the fold. The clamp element 53 may serve to secure the folded product 52 against sliding out of the compartment 44, in particular in the lower region of the processing drum 40. Likewise, the clamp element 53, with an appropriate design, can ensure that the folded products 52 are conveyed transversely with respect to the direction of rotation of the processing drum 40.

In order to carry out complex folding operations, it may be expedient to provide the folding devices according to FIGS. 1, 3 and 4 on a single processing drum such that they are offset axially with respect to one another. In this case, both horizontally and vertically running folds can be produced, it being possible for the folded product to be oriented, when it is removed from the processing drum, such that the last-produced fold comes to lie at the top, at the bottom, on the left or on the right.

Figure 5:
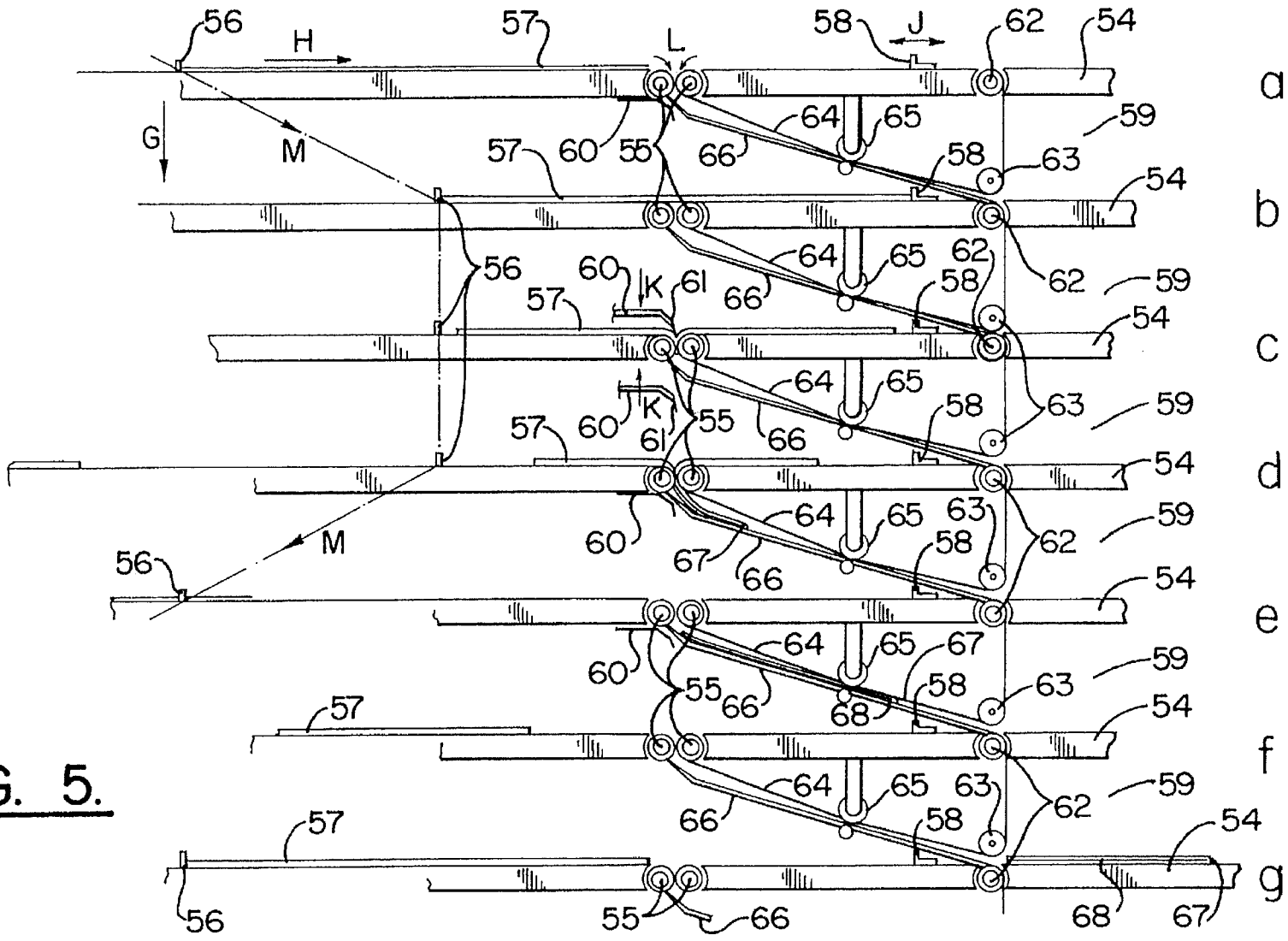
FIG. 5 shows, in various operating states, individual receiving positions which follow sequentially along a processing section and are provided with folding devices according to the invention.

FIG. 5 shows individual receiving positions which follow one after the other along a processing section, are moved in the direction of the arrow G, are provided according to the invention with folding devices and are located in various operating states in accordance with their respective position in the processing section.

FIG. 5 shows, in the positions a to g, seven successive wall elements 54 which are designed corresponding to FIG. 1 and extend perpendicularly with respect to the conveying direction G. The representation of FIG. 5 thus corresponds essentially to the projected-development outer surface of a processing drum according to FIG. 1.

Integrated into each of the wall elements 54 is a pair of folding rollers 55, of which the diameter corresponds approximately to the thickness of the wall elements 54.

Provided on each wall element 54 is a pusher 56 which may be designed, for example, corresponding to European Patent Application EP-A-550828 which is incorporated herein by reference and is suitable for conveying a sub-product 57 which is to be folded, in the direction of the arrow H, into the region of the folding rollers 55. In this arrangement, the pusher can be moved both in the direction of the arrow H and in the opposite direction.

Located on the same side of the wall element 54 on which the pusher 56 is fitted is a stop 58 which can be adjusted in the direction of the double arrow J, said stop 58 being arranged on that side of the folding rollers 55 which is directed away from the pusher 56.

Arranged in each compartment 59 formed between two adjacent wall elements 54 is a folding tongue 60 which can be moved along the arrows K and exhibits a folding edge 61 in its front region.

In a manner offset in the conveying direction H with respect to the folding rollers 55, a deflection roller 62 is integrated into each wall element 54, the axis of rotation of said deflection roller running parallel to the axis of rotation of the folding rollers 55.

A further deflection roller 63 is spaced apart from the deflection roller 62 in the direction of the arrow G, the distance between the two deflection rollers 62 and 63 corresponding essentially to the width of a compartment 59.

Running over the deflection rollers 62, 63 and over the folding roller 55 directed towards the deflection roller 62 is a conveying belt 64 which is supported, in the region located between the folding roller 55 and the deflection roller 63, on an additional guide roller 65.

The conveying belt 64 is driven either via one of the deflection rollers 62, 63 or via the folding roller 55. It is preferably driven via the folding roller 55.

Essentially parallel to that region of the conveying belt 64 which runs between the folding roller 55 and the deflection roller 63 there extends a bearing rail 66 in a manner running obliquely from a wall element 54 to a wall element 54 adjacent to this. In the region of the folding rollers 55, the bearing rail 66 is angled in order to ensure precise guidance of a folded product 68 on the outlet side of the folding rollers 55.

The apparatus represented in FIG. 5 functions as follows:

A sub-product 57 which is to be folded and bears on the pusher 56 with its rear end (position a) is conveyed into the region of the folding rollers 55 in the direction of the arrow H until its front end comes to butt against the stop 58 (position b). The distance between the leading edge of the sub-product 57 which is to be folded and the fold edge which is to be produced can be set by an adjustment of the stop 58 in the direction of the double arrow 3. In this manner, the apparatus according to FIG. 5 can be set to various product formats, it being possible, in particular, also to produce off-center folds, as are required, for example, for pre-folded sub-products.

Once the sub-product 57 which is to be folded has come to butt against the stop 58 with its leading edge, the folding tongue 60 is moved in the direction of the gap formed between the folding rollers 55 (position c). Consequently, that region of the sub-product 57 which is to be folded is forced into the gap formed between the folding rollers 55 by means of the folding edge 61 of the folding tongue 60.

By virtue of rotation of the folding rollers 55 in the direction of the arrow L (position a), the sub-product 57 which is to be folded is drawn through the gap formed between the folding rollers 55 with its fold 67 in front (position d). In this arrangement, the sub-product 57 used in the folding process is guided, on the outlet side of the gap formed between the folding rollers 55, by way of the bearing rail 66.

As soon as the sub-product 57 which is to be folded has been seized by the folding rollers 55, the pusher 56 can be displaced back into its initial position (position e). During movement of the wall elements 54 in the direction of the arrow G, the pusher 56 thus describes a movement corresponding to the arrow M depicted in FIG. 5.

The folded product 68 released from the folding rollers 55 is clamped in between the bearing rail 66 and the circulating conveying belt 64 and is thus conveyed further in the direction of the wall element 54 adjacent to the folding rollers 55 on the outlet side thereof (positions f and g).

By virtue of the folding operation described, a sub-product 57 which is to be folded passes from one compartment 59 into a compartment 59 adjacent to this, said folding operation being effected by a folding device which is integrated in a wall element which delimits the two adjacent compartments 59 from one another.

By means of an apparatus represented in FIG. 5, continuously occurring sub-products which are to be folded can be processed in the same way as with apparatuses according to FIGS. 1 to 4.

FIG. 6 shows the flow chart of a folding operation which can be effected by an apparatus according to FIG. 3.

The sub-products 69 which are to be folded are fed in the arrow direction to the processing drum 25 rotating in the axis of rotation 26 in the arrow direction, whereupon said sub-products are conveyed within the compartments, perpendicularly with respect to the feeding direction, into the region of the folding devices.

If a sub-product 69' is located in the region of the folding devices, the folding operation is carried out during the rotation of the processing drum 25, this finally resulting in a folded product 70, of which the fold edge runs parallel to the axis of rotation 26 of the processing drum 25.

The folded product 70 is conveyed away from the processing drum 25 in a direction which is offset in parallel with the feeding direction.

FIG. 7 shows a flow chart of a folding operation which can be carried out by a combination of the apparatuses according to FIGS. 1 and 3.

In the case of such a combination, each compartment of the processing drum 71 is provided with in each case two folding devices which are suitable for producing folds running perpendicularly with respect to one another.

The sub-products 73 which are to be folded are fed in the arrow direction to the processing drum 71 rotating about the axis 72 in the arrow direction.

During a transporting movement directed perpendicularly with respect to the feeding direction and parallel with respect to the axis of rotation 72, the sub-product 73 which is to be folded runs through a folding device according to FIG. 1, this producing a fold 74 running perpendicularly with respect to the axis of rotation 72.

During rotation of the processing drum 71, the product 75 folded once in this manner then runs through a further folding device, which is designed corresponding to FIG. 3. This produces a further fold 76 which runs perpendicularly with respect to the fold 74.

The twice-folded product 77 is conveyed away from the processing drum 71 in a direction offset parallel to the feeding direction.

FIG. 8 shows the flow chart of a folding operation which can be effected by an apparatus according to FIG. 4.

The sub-product 42 which is to be folded is already fed to the processing drum 40, rotating about the axis 45, in the region of the folding devices.

The folding devices, each exhibiting two folding rollers 46, produce a fold 78 which runs parallel to the axis of rotation 45 of the processing drum 40.

The single-fold products 79 produced in this manner come to lie in the compartments 44 with the fold 78 directed towards the axis of rotation 45 and, within the compartments 44, are conveyed away in the arrow direction out of the region of the folding devices, perpendicularly with respect to the feeding direction and parallel with respect to the axis of rotation 45.

The region of the compartments 44 in which the single-fold products 79 come to lie after the folding operation is, in radial terms, less remote from the axis of rotation 45 of the processing drum 40 than the folding devices. In this region of the processing drum 40, a collecting process may additionally take place by means of a collecting station (not shown in FIG. 8).

Finally, the folded products 79 are removed from a region of the processing drum 40 which is arranged offset, in the direction of the axis of rotation 45, with respect to the folding devices and are conveyed away from the processing drum 40 counter to the feeding direction.

FIG. 9 shows a flow chart of a folding operation which can be effected by an apparatus according to FIG. 3 or 4.

The sub-products 80 which are to be folded are fed in the arrow direction to the processing drum 82 rotating about the axis 81, the feeding being carried out in that sector of the processing drum 82 which is provided with the folding devices.

Once, with continued rotation of the processing drum 82, the folding operation has been carried out by one of the apparatuses according to FIG. 3 or 4, the folded product 83 is conveyed away from the processing drum 82, the conveying-in direction and the conveying-away direction in FIG. 9 running in an essentially identical manner and not running offset with respect to one another.

If, in the case of the flow chart according to FIG. 9, use is made of a folding device according to FIG. 3, the conveying-away operation takes place with the fold leading.

If, however, in the case of the flow chart according to FIG. 9, use is made of a folding device according to FIG. 4, the conveying-away operation takes place with the fold trailing.

FIG. 10 shows the flow chart according to FIG. 9, including the performance of a further folding operation.

Instead of the folded products being conveyed away according to FIG. 9, as is represented in dotted lines in FIG. 10, the once-folded product 83 is conveyed, in a compartment, parallel to the axis of rotation 84 of the processing drum 85, a further fold which runs perpendicularly with respect to the previously produced fold being produced during this conveying operation. Said further fold can be produced, for example, by an apparatus according to FIG. 1. In this manner—as also with an apparatus according to FIG. 7—a product 86 with two mutually perpendicular folds can thus be produced.

FIG. 11 shows the flow chart of a folding operation carried out according to the invention, with a combined insertion operation.

The sub-product 87 which is to be folded and is already pre-stapled by means of staples 87' is introduced into a compartment of a processing drum or of a circulating system until it comes to butt against the lower region 88 of the compartment with its lower edge.

The sub-product 87 is then folded, transported in the longitudinal direction of the compartment and opened, the bloom of the folded product 89 coming to lie on the side which is directed away from the processing drum or the circulating system.

Subsequently, a printed sub-product 90 is inserted into the folded product 89 in the arrow direction.

After further conveying along the compartment, the folded product 89, along with the inserted sub-product 90, is conveyed away from the apparatus in the arrow direction.

The flow chart according to FIG. 11 shows that, according to the invention, folding and insertion can be effected by a single apparatus. In the same way, an apparatus according to the invention may also be coupled to a stapling and/or adhesive bonding station.

The flow chart according to FIG. 11 may also be used on non-pre-stapled sub-products comprising one or more individual sub-products.

Finally, according to FIG. 11, other processing operations may also be carried out, alternatively or in addition to insertion, on pre-stapled sub-products.

FIG. 12 shows a drive flow chart for folding rollers of a folding device according to the invention, which is designed, in particular, corresponding to FIG. 8. Said drive flow chart may also be used, in a correspondingly modified manner, in the case of folding rollers oriented parallel to the axis of rotation of the processing drum.

Two interacting folding rollers 91 are retained in a wall element 92 of a processing drum, the axes of rotation 93 of the folding rollers 91 running parallel to the axis of rotation of the processing drum.

The folding rollers 91 are each coupled fixedly to a gear wheel 94 which is arranged concentrically with respect to their axes of rotation 93, the two gear wheels 94 meshing with one another.

The gear wheel 94 of one of the two folding rollers 91 is coupled to a gear wheel 95 which is offset axially thereto and is, in turn, in engagement with a gear wheel 96 which is arranged concentrically with respect to the axis of rotation of the processing drum. Said gear wheel 96 is of a stationary design and, accordingly, does not rotate together with the processing drum.

Upon rotation of the processing drum, the gear wheel 95 rolls on the stationary gear wheel 96 and thus effects a rotation of the gear wheel 94 coupled to the gear wheel 95. Since the two gear wheels 94 mesh with one another, the two folding rollers 91 are, in this manner, rotated in opposite directions.

By means of the principle represented in FIG. 12, a multiplicity of pairs of folding rollers 91, each integrated in a wall element 92 of a processing drum, can be driven in a simple manner.

While particular embodiments of the invention have been described, it will be understood, of course, the invention is not limited thereto since modifications may be made by those skilled in the art, particularly in light of the foregoing teachings. It is, therefore, contemplated by the appended claims to cover any such modifications that incorporate those features of these improvements in the true spirit and scope of the invention.

That which is claimed is:

1. An apparatus for producing printed products composed of one or more individual sub-products, said apparatus comprising a plurality of successive receiving positions arranged between at least one sub-product feeding station and at least one product removal station, wherein at least one of the receiving positions is each provided with at least one folding device, each folding device comprising a pair of folding rollers and a folding tongue mounted for movement so as to move the sub-product which is to be folded between the folding rollers.

2. An apparatus according to claim 1, wherein the receiving positions are designed as pocket-like compartments wherein adjacent compartments are delimited from one another by a wall element.

3. An apparatus according to claim 2, further comprising a rotationally driven processing drum comprising a substantially horizontal axis of rotation, said drum comprising a plurality of said wall elements extending away essentially radially from the horizontal axis of rotation which are arranged on the processing drum such that they are distributed at regular intervals along the circumference of said drum.

4. An apparatus according to claim 2, further comprising a drawing member driven in circulation about two spaced-apart horizontal axes and wherein said wall elements are arranged on the drawing member such that they run essentially perpendicular thereto and are distributed at regular intervals in the direction of circulation of the members.

5. An apparatus according to claim 2, wherein each of the said wall elements include at least one folding device wherein the sub-products are conveyed and simultaneously folded from one compartment into an adjacent compartment.

6. An apparatus according to claim 2, wherein each compartment comprises at least one conveying-in sector and at least one conveying-away sector, said conveying-in and conveying-away sectors being delimited from one another by a partition wall extending essentially parallel to the wall elements.

7. An apparatus according to claim 1, wherein said at least one receiving position is provided with a first folding device having a folding roller pair with approximately vertical longitudinal axes and with a second folding device having a folding roller pair which is arranged offset with respect to the first folding roller pair and having approximately horizontal longitudinal axes.

8. An apparatus according to claim 3 wherein each folding roller of each folding roller pair is coupled to a gear wheel, with the two gear wheels assigned to a folding roller pair meshing with one another, and with one of said two gear wheels being in engagement with a stationary gear wheel arranged concentrically with respect to the axis of rotation of the processing drum.

9. An apparatus according to claim 1, wherein each folding tongue is mounted pivotably and is connected to a lever element which can be actuated via a stationary guide.

10. An apparatus according to claim 1, wherein each folding device further comprises a conveying device comprising a conveying belt for conveying away the folded products, said conveying belt being positioned on that side of the pair of folding rollers which is directed away from the folding tongue.

11. An apparatus according to one claim 1, wherein the receiving positions each comprise an adjustable stop for positioning the sub-products to be folded.

12. An apparatus according to claim 1, wherein the receiving positions are each provided with conveying means which transport the sub-products in the receiving positions perpendicularly with respect to the movement direction of the receiving positions.

13. An apparatus according to claim 1, wherein said one sub-product feeding station conveys the sub-products by means of grippers into the region of the folding devices, and said one product removal station conveys away the products by means of grippers out of the region of the folding devices.

14. An apparatus according to claim 1, wherein the receiving positions are arranged between at least one sub-product feeding station and at least one product removal station along a processing section, said apparatus further comprising insertion or collating stations which interact with the receiving positions.

15. An apparatus according to claim 1, wherein the receiving positions are arranged between at least one sub-product feeding station and at least one product removal station along a processing section, said apparatus further comprising collecting, stapling or adhesive-bonding stations which interact with the receiving positions.

* * * * *